US009780504B2

(12) United States Patent
Wang et al.

(10) Patent No.: US 9,780,504 B2
(45) Date of Patent: Oct. 3, 2017

(54) ELECTRICAL RECEPTACLE CONNECTOR

(71) Applicant: ADVANCED-CONNECTEK INC., New Taipei (TW)

(72) Inventors: Yao-Te Wang, New Taipei (TW); Ya-Ling Chen, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 23 days.

(21) Appl. No.: 14/962,846

(22) Filed: Dec. 8, 2015

(65) Prior Publication Data

US 2016/0172801 A1 Jun. 16, 2016

(30) Foreign Application Priority Data

Dec. 12, 2014 (TW) ..... 103143584 A

(51) Int. Cl.

| | |
|---|---|
| ***H01R 24/60*** | (2011.01) |
| ***H01R 13/506*** | (2006.01) |
| ***H01R 27/02*** | (2006.01) |
| *H01R 13/6594* | (2011.01) |
| *H01R 13/6461* | (2011.01) |
| *H01R 13/6471* | (2011.01) |
| *H01R 27/00* | (2006.01) |
| *H01R 107/00* | (2006.01) |

(52) U.S. Cl.

CPC ..... *H01R 24/60* (2013.01); *H01R 13/506* (2013.01); *H01R 2107/00* (2013.01)

(58) Field of Classification Search

CPC .... H01R 27/02; H01R 13/506; H01R 12/724; H01R 13/6594; H01R 24/60; H01R 12/716; H01R 13/6461; H01R 13/6471; H01R 13/659; H01R 27/00; H01R 24/64; H01R 13/658; H01R 23/6873; H01R 24/00

USPC ..... 439/660, 541.5

See application file for complete search history.

(56) References Cited

U.S. PATENT DOCUMENTS

| | | | | |
|---|---|---|---|---|
| 7,467,977 | B1 * | 12/2008 | Yi | H01R 12/7023 439/541.5 |
| 7,473,136 | B2 * | 1/2009 | Hu | H01R 12/716 439/541.5 |
| 7,559,805 | B1 * | 7/2009 | Yi | H01R 13/6658 439/660 |

(Continued)

*Primary Examiner* — James Harvey
*Assistant Examiner* — Matthew T Dzierzynski
(74) *Attorney, Agent, or Firm* — Muncy, Geissler, Olds & Lowe, P.C.

(57) ABSTRACT

An electrical receptacle connector includes an insulated housing, conductive terminals, and a fixing base. The insulated housing defines a connecting space therein. The insulated housing includes a tongue portion extending into the connecting space and a base portion arranged at the rear part of the tongue portion. The base portion has a rear wall, two lateral walls extended backward from the rear wall, and an assembling space defined by the rear wall and the two lateral walls. The fixing base is received in the assembling space and defines first through holes and second through holes. The pins of the conductive terminals are passing through the first through holes and the second through holes. The fixing base has a rear wall surface defining grooves communicating with the respective first through holes. The width of the groove is less than the width of the corresponding first through hole.

10 Claims, 9 Drawing Sheets

(56) References Cited

U.S. PATENT DOCUMENTS

| | | | | |
|---|---|---|---|---|
| 7,654,871 | B2 * | 2/2010 | Yi | H01R 13/6658 439/660 |
| 7,789,706 | B2 * | 9/2010 | Chen | H01R 13/504 439/607.35 |
| 7,878,847 | B2 * | 2/2011 | He | H01R 27/00 439/541.5 |
| 7,887,370 | B2 * | 2/2011 | Chen | H01R 13/506 439/607.35 |
| 7,922,533 | B2 * | 4/2011 | Wang | H01R 27/02 439/541.5 |
| 8,202,120 | B2 * | 6/2012 | Ko | H01R 12/57 439/607.35 |
| 8,251,747 | B2 * | 8/2012 | He | H01R 13/65802 439/607.28 |
| 8,388,372 | B2 * | 3/2013 | He | H01R 27/02 439/101 |
| 8,944,848 | B1 * | 2/2015 | Yu | H01R 24/64 439/607.01 |
| 9,039,457 | B2 * | 5/2015 | Zhang | H01R 13/6275 439/357 |
| 9,337,589 | B2 * | 5/2016 | Wang | H01R 13/6461 |
| 2014/0017951 | A1 * | 1/2014 | Tsai | H01R 13/516 439/638 |
| 2014/0357122 | A1 * | 12/2014 | Zheng | H01R 13/6581 439/607.27 |
| 2014/0364007 | A1 * | 12/2014 | Wang | H01R 13/6596 439/607.01 |

* cited by examiner

100

ELECTRICAL RECEPTACLE CONNECTOR

CROSS-REFERENCES TO RELATED APPLICATIONS

This non-provisional application claims priority under 35 U.S.C. §119(a) on Patent Application No. 103143584 filed in Taiwan, R.O.C. on 2014 Dec. 12, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

An existing USB 3.0 Type-B electrical receptacle connector includes an insulated housing, an upper tongue, and a lower tongue. The upper tongue and the lower tongue are arranged at the front part of the insulated housing. Upper-row contact terminals for USB 3.0 signal transmission are assembled to the upper tongue, and lower-row contact terminals for USB 2.0 signal transmission are assembled to the lower tongue. Therefore, the electrical receptacle connector is allowed to connect to an electrical plug connector. Generally, the legs of the contact terminals (the upper-row contact terminals and the lower-row contact terminals) are extended out of the rear part of the insulated housing and are further assembled to a positioning base at the rear part of the insulated housing. However, for the existing electrical receptacle connector having the positioning base, the matching between the positioning base and the insulated housing and the matching between the legs of the contact terminals and the positioning base have to be considered thoroughly so as to position the legs of the contact terminals steadily. In addition, the overall cost and the overall size of the electrical receptacle connector have to be considered as well.

SUMMARY OF THE INVENTION

It is therefore necessary to establish and develop a new architecture of USB connectors to address the previously mentioned needs of platforms and devices, while retaining all of the functional benefits of USB that form the basis for this most popular of computing device interconnects.

In view of this, the instant disclosure provides an electrical receptacle connector. An embodiment of the electrical receptacle connector comprises a metallic shell, an insulated housing, a plurality of conductive terminals, and a fixing base. The metallic shell defines a receiving cavity therein. The insulated housing is received in the receiving cavity.

The insulated housing defines a connecting space therein. The insulated housing comprises a tongue portion and a base portion. The tongue portion is extended into the connecting space, and the base portion is arranged at the rear part of the tongue portion. The connecting space comprises a first connecting partition and a second connecting partition communicating with each other. The tongue portion comprises a first tongue and a second tongue parallel to each other. The first tongue is received in the first connecting partition, and the second tongue is received in the second connecting partition. The base portion has a rear wall, two lateral walls, an assembling space, and a plurality of terminal positioning slots. The two lateral walls are extended backward from the rear wall. The assembling space is defined by the rear wall and the two lateral walls. The terminal positioning slots are defined through the rear wall and communicate with the assembling space and the connecting space. The conductive terminals comprise a plurality of first terminals and a plurality of second terminals. The first terminals and the second terminals are inserted into the respective terminal positioning slots. The first terminals are at the first tongue, and the second terminals are at the second tongue. Each of the first terminals and the second terminals has a pin extended backward from the corresponding terminal positioning slot to the assembling space, such that the pins of the first terminals and the pins of the second terminals are bent and extended vertically. The fixing base is received in the assembling space. The fixing base defines a plurality of first through holes and a plurality of second through holes. The pins of the first terminals are passing through the respective first through holes, and the pins of the second terminals are passing through the respective second through holes. The fixing base has a rear wall surface defining a plurality of grooves, the grooves communicate with the respective first through holes, wherein the width of each of the grooves is less than the width of the corresponding first through hole.

Based on the above, the grooves are defined on the rear wall surface of the fixing base and communicate with the respective first through holes. Further, the grooves are defined through the baffle plate from the respective first through holes to the rear wall surface of the baffle plate. In addition, for each of the first through holes, parts of the inner wall of the first through hole are opened and communicate with the outside of the fixing base through the corresponding groove. Further, each of the grooves is defined through the baffle plate from a top thereof to a bottom thereof. Therefore, the cost of the material for manufacturing the fixing base can be reduced, and the overall cost of the electrical receptacle connector can be reduced as well.

Detailed description of the characteristics, and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
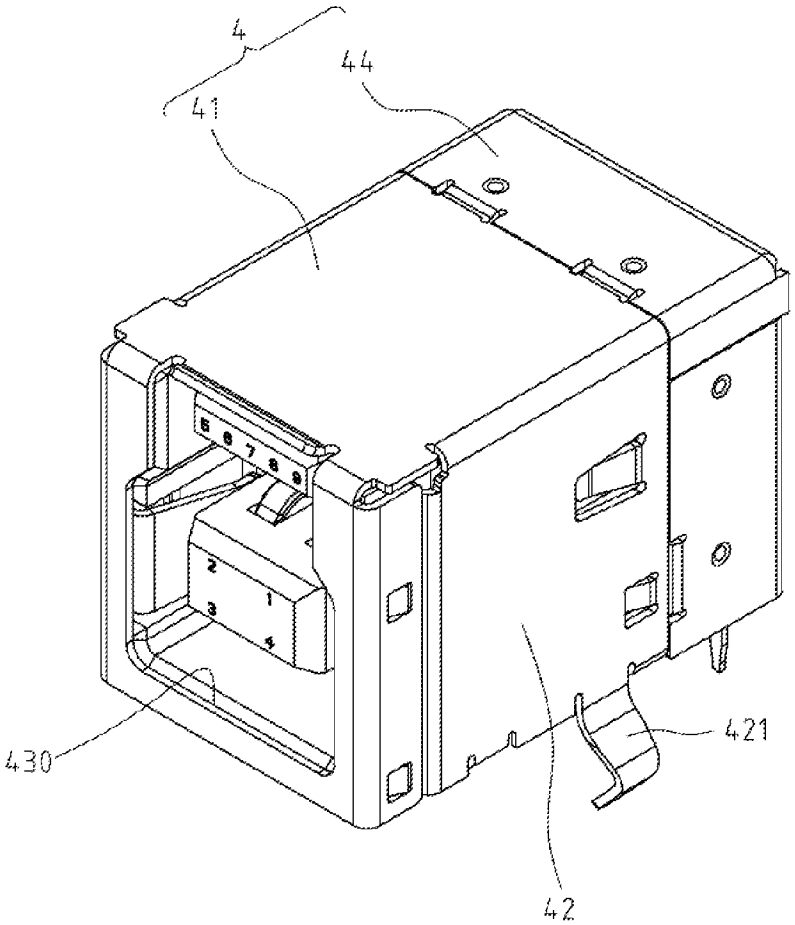
FIG. 1 is a perspective view of an electrical receptacle connector according to the instant disclosure.
Figure 2:
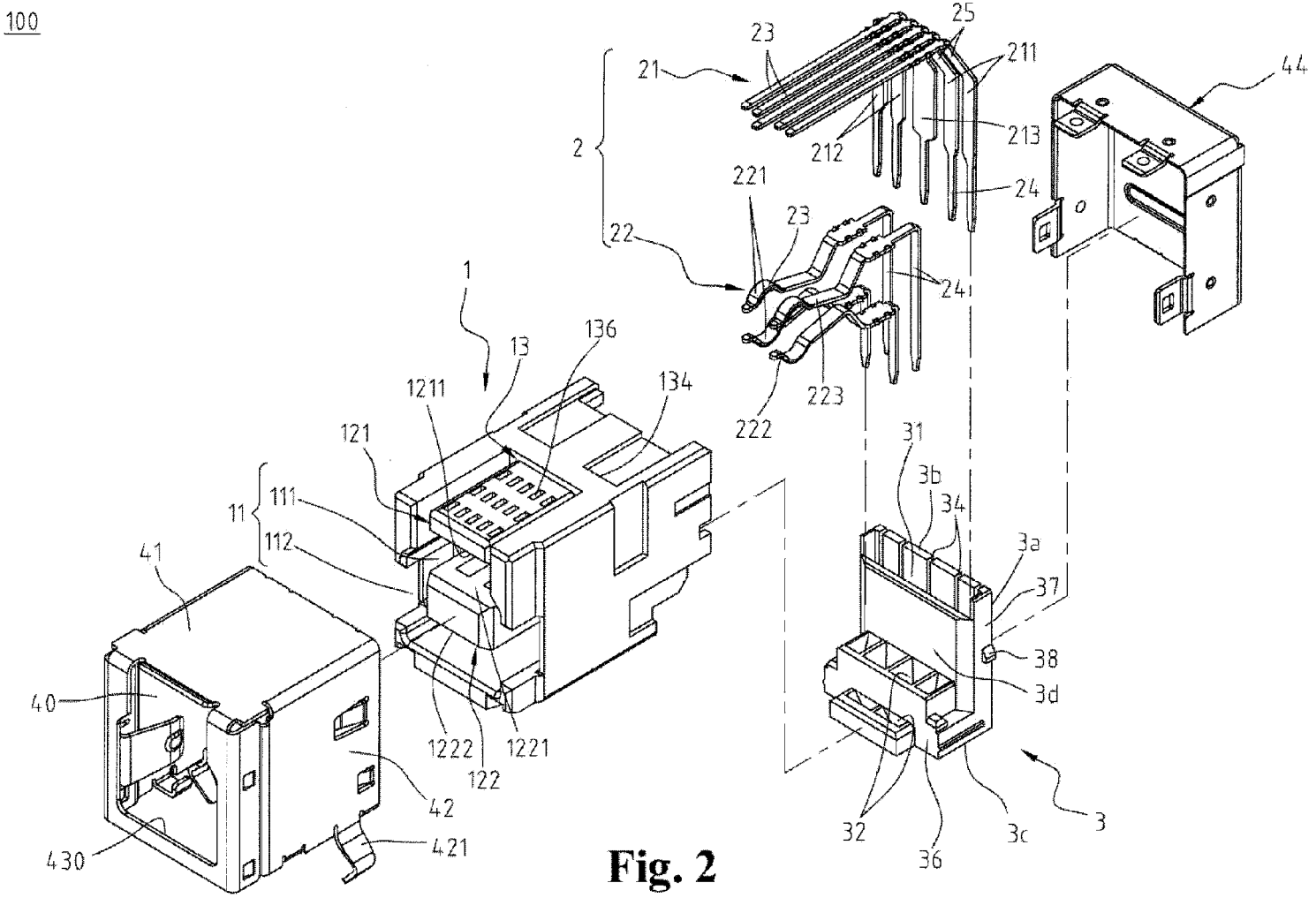
FIG. 2 is a front exploded view of the electrical receptacle connector.
Figure 3:
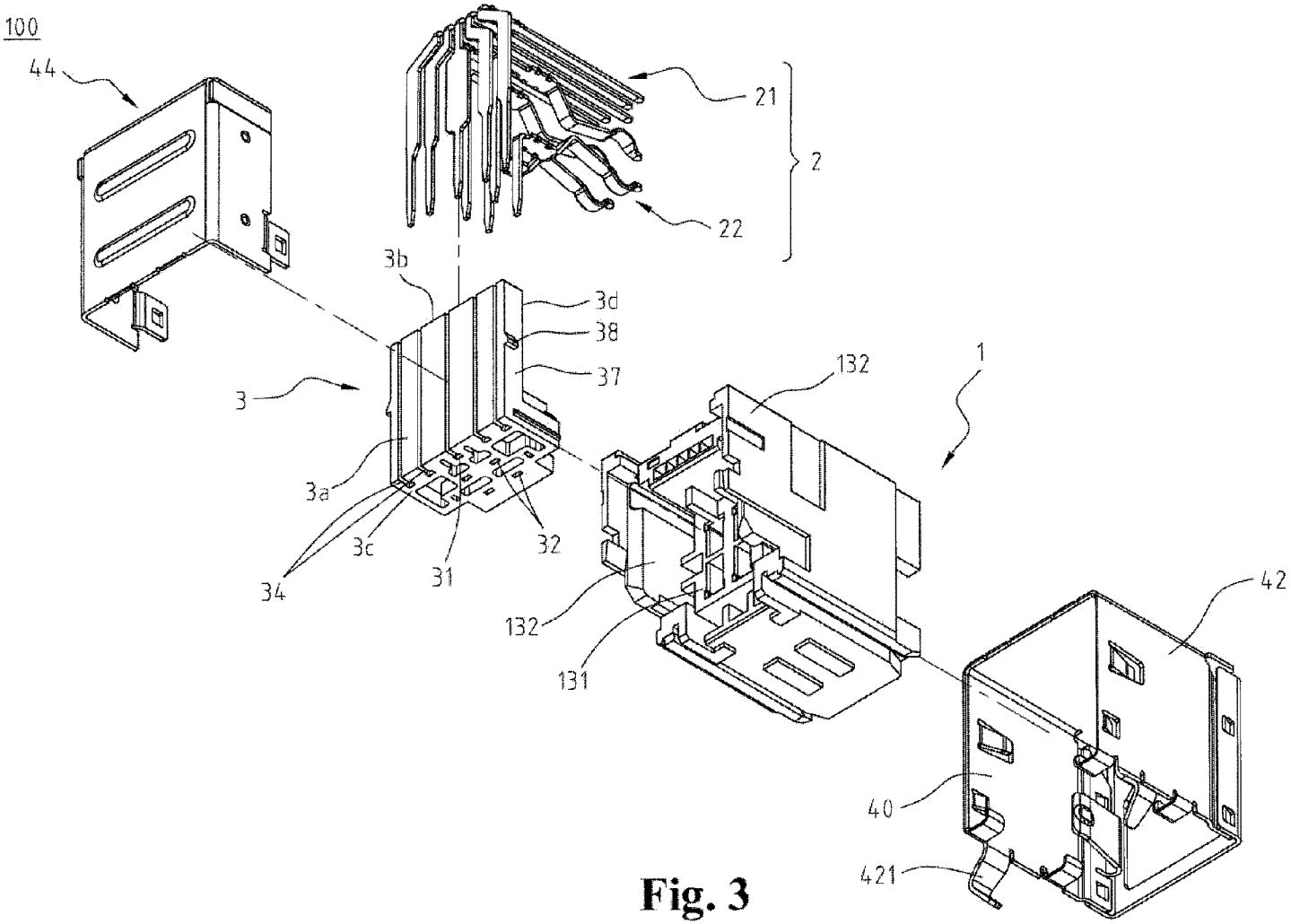
FIG. 3 is a back exploded view of the electrical receptacle connector.

Please refer to FIG. 1 to FIG. 3, illustrating an exemplary embodiment of an electrical receptacle connector 100 according to the instant disclosure. FIG. 1 is a perspective view, FIG. 2 is a front exploded view, and FIG. 3 is a back exploded view, of the electrical receptacle connector 100. The electrical receptacle connector 100 described herein is a USB 3.1 electrical connector met the specification announced by USB-IF organization. The electrical receptacle connector 100 is conformed to the specification of a USB 3.0 Type-B connection interface and is capable to perform 10 Gigabytes transmission speed. The electrical receptacle connector 100 may be physically connected with a USB 2.0 Type-B electrical plug connector, a USB 3.0 Type-B electrical plug connector, or a USB 3.1 Type-B electrical plug connector. The electrical receptacle connector 100 comprises an insulated housing 1, a plurality of conductive terminals 2, and a metallic shell 4. The conductive terminals 2 are arranged at the insulated housing 1. The metallic shell 4 surrounds four sides of the insulated housing 1.

Please refer to FIG. 2 and FIG. 3. The insulated housing 1 defines a connecting space 11 therein, and the insulated housing 1 comprises a tongue portion 12 and a base portion 13. The connecting space 11 comprises a first connecting partition 111 and a second connecting partition 112 below the first connecting partition 111 and communicating with the first connecting partition 112. The volume of the first connecting partition 111 is less than the volume of the second connecting partition 112. The tongue portion 12 comprises a first tongue 121 and a second tongue 122 parallel to each other. The first tongue 121 is extended forward to be received in the first connecting partition 111, and the second tongue 122 is received in the second connecting partition 112. The first tongue 121 and the second tongue 122 are extended from one side of the base portion 13. That is, the base portion 13 is arranged at the rear part of the tongue portion 12 (namely, the first tongue 121 and the second tongue 122 are extended from the front part of the base portion 13). In addition, the thickness of the first tongue 121 is less than the thickness of the second tongue 122.

Figure 4:
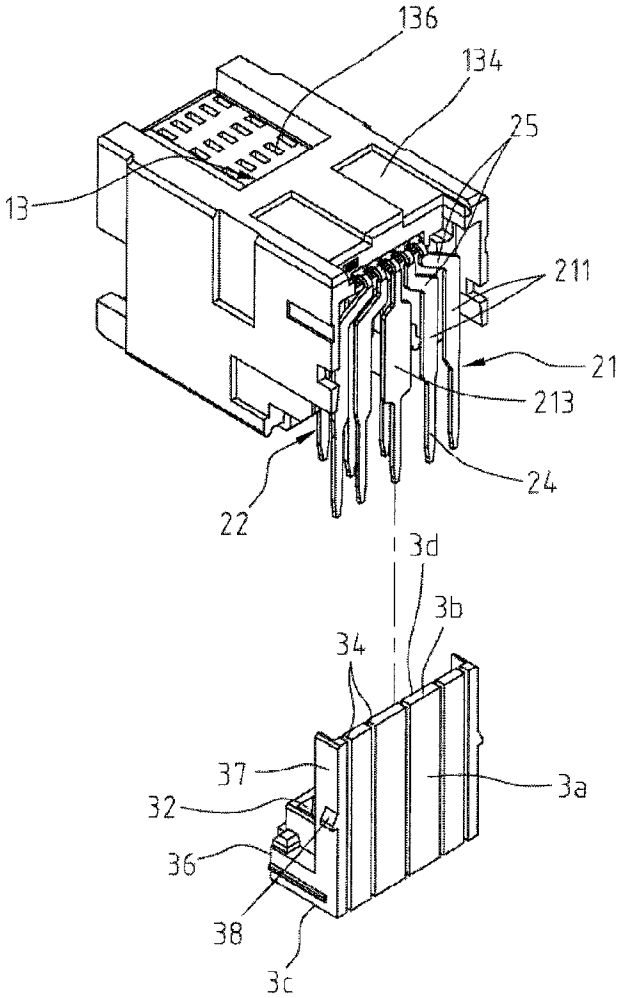
FIG. 4 is a partial exploded view of a fixing base and a plurality of conductive terminals of the electrical receptacle connector.

As shown in FIG. 3 and FIG. 4, the base portion 13 has a rear wall 131, two lateral walls 132, an assembling space 134, and a plurality of terminal positioning slots 136. The two lateral walls 132 are extended backward from the rear wall 131. The assembling space 134 is defined by the rear wall 131 and the two lateral walls 132. The terminal positioning slots 136 are defined through the rear wall 131, wherein the assembling space 134 and the connecting space 11 communicate with each other through the terminal positioning slots 136.

Please refer to FIG. 1 and FIG. 2. The first tongue 121 has a first surface 1211 facing the second tongue 122. The second tongue 122 has a second surface 1221 and a third surface 1222 opposite to the second surface 1221. Specifically, the lower surface of the first tongue 121 is the first surface 1211, the upper surface of the second tongue 122 is the second surface 1221, and the lower surface of the second tongue 122 is the third surface 1222. Recesses corresponding to the terminal positioning slots 136 are formed on the first surface 1211 and the second surface 1221.

Please refer to FIG. 2 and FIG. 3. The conductive terminals 2 comprise a plurality of first terminals 21 and a plurality of second terminals 22. The second terminals 22 may be USB 2.0 Type-B receptacle terminals to connect with the USB 2.0 Type-B plug terminals of an electrical plug connector. The first terminals 21 and the second terminals 22 are USB 3.0 Type-B terminals to connect with the USB 3.0 Type-B or USB 3.1 Type-B plug terminals of an electrical plug connector. Each of the conductive terminals 2 comprises a flat contact portion 23 formed at the front portion thereof, a bending portion 25 formed at the middle portion thereof, and a tail portion 24 formed at the rear portion thereof.

Please further refer to FIG. 2 to FIG. 5. In this embodiment, the number of the first terminals 21 is five, and the five pins of the five first terminals 21 are arranged in a row. The first terminals 21 comprise a first pair of differential signal terminals 211, a second pair of differential signal terminals 212, and a first ground terminal 213. The first pair of differential signal terminals 211 comprises a first signal terminal and a second signal terminal. The second pair of differential signal terminals 212 comprises a third signal terminal and a fourth signal terminal. The first terminals 21 are arranged along the width direction of the first tongue 121, by the order of the first signal terminal, the second signal terminal, the first ground terminal 213, the third signal terminal, and the fourth signal terminal. That is, the first terminals 21 comprise the first ground terminal 213 and two pairs of differential signal terminals 211, 212 arranged at two sides of the first ground terminal 213. In other words, the structures of the first signal terminal and the fourth signal terminal are symmetrical about the central axis of the first ground terminal 213, and the structures of the second signal terminal and the third signal terminal are symmetrical about the central axis of the first ground terminal 213. The distance between the first signal terminal and the second signal terminal is equal to the distance between the third signal terminal and the fourth signal terminal. The first ground terminal 213 is arranged between the second signal terminal and the third signal terminal, wherein the tail portions 24 of the second signal terminal and the third signal terminal are offset outwardly from the central axis of the first ground terminal 213. Therefore, the distance between the tail portions 24 of the first pair of differential signal terminals 211 and the tail portions 24 of the second pair of differential signal terminals 212 can be further increased so as to reduce the interferences between the differential signal terminals 211, 212 and to improve the high frequency performance of the two pairs of differential signal terminals 211, 212. Accordingly, the transmission speed of the electrical receptacle connector 100 according to this embodiment can be further improved and meets nowadays user requirements.

Specifically, the flat contact portion 23 of each of the first terminals 21 is arranged at the first surface 1211 of the first tongue 121, the tail portion 24 of each of the first terminals 21 is extended vertically (from the view of FIG. 4) to pass through the fixing base 3. In other words, each terminal of the two pairs of differential signal terminals 211, 212 comprises the flat contact portion 23 arranged at the first tongue 121, the tail portion 24 extended from the rear portion of the flat contact portion 23 and passing through the corresponding first through hole 31 of the fixing base 3, and the bending portion 25 formed between the flat contact portion 23 and the tail portion 24.

Please refer to FIG. 2 to FIG. 5. The width of the pin of the first ground terminal 213 may be, but not limited to, greater than the width of the pin of each terminal of the two pairs of differential signal terminals 211, 212. That is, the width of the tail portion 24 of the first ground terminal 213 is greater than the width of the tail portion 24 of each terminal of the first pair of differential signal terminals 211, and the width of the tail portion 24 of the first ground terminal 213 is also greater than the width of the tail portion 24 of each terminal of the second pair of differential signal terminals 212. Accordingly, the terminal configuration mentioned above would improve the grounding performance of the first ground terminal 213. In addition, the aforementioned terminal configuration can improve signal interferences between the pairs of the differential signal terminals 211, 212 resulting from the increase of the signal transmission speed, and the aforementioned terminal configuration can reduce electromagnetic interference (EMI) problems.

Figure 5:
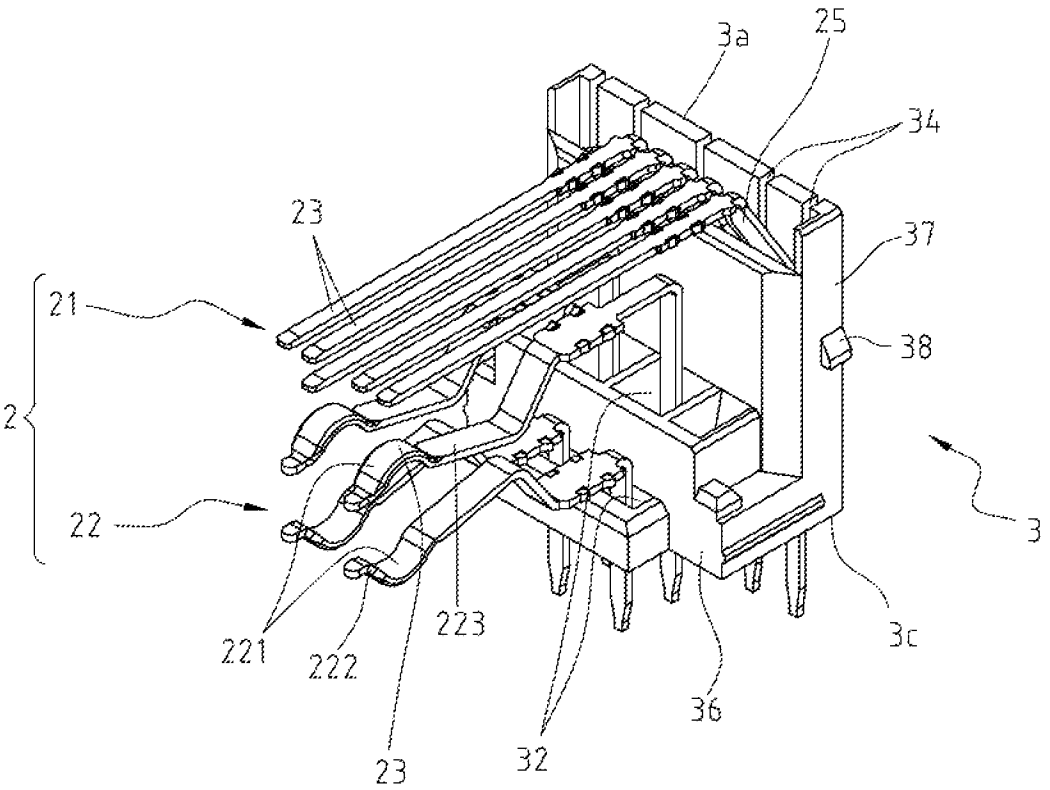
FIG. 5 is an assembled schematic view showing the fixing base is assembled with the conductive terminals.
Figure 6:
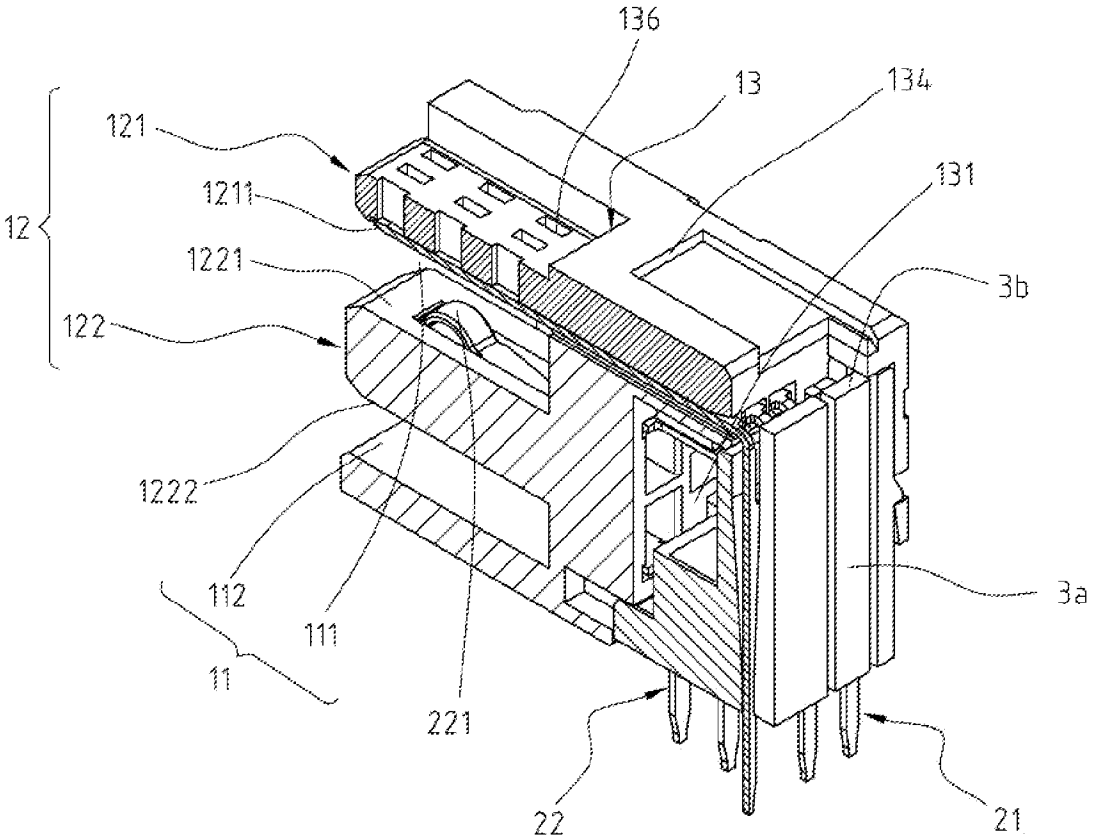
FIG. 6 is a lateral sectional view of the electrical receptacle connector.
Figure 7:
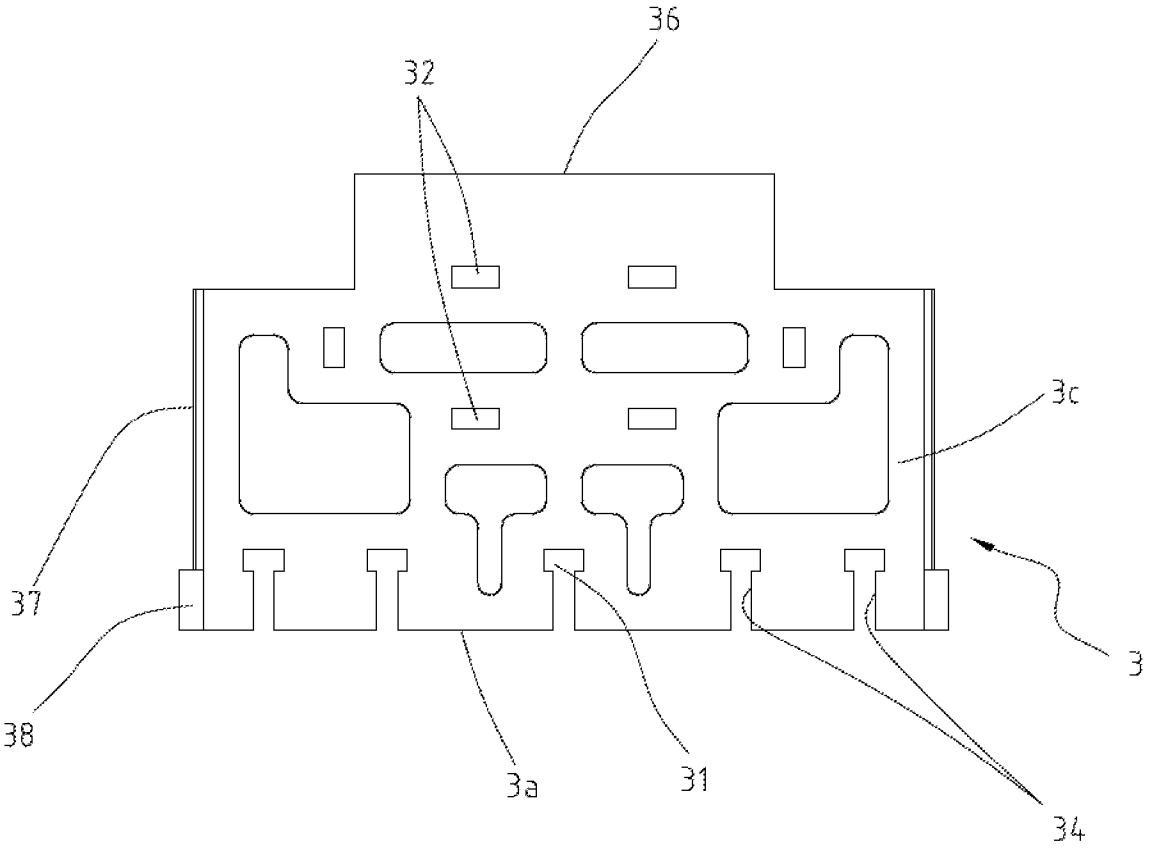
FIG. 7 is a bottom view of the fixing base of the electrical receptacle connector.

Please refer to FIG. 2 to FIG. 5. In this embodiment, the number of the second terminals 22 is four, and the four pins of the four second terminals 22 are arranged alternately, such that the four pins of the four second terminals 22 are arranged as two parallel rows. In other words, the first pin and the third pin of the second terminals are aligned into a row, and the second pin and the four pin of the second terminals are aligned into another row. The second terminals 22 comprise a third pair of differential signal terminals 221, a second ground terminal 222 and a power supply terminal 223. The third pair of differential signal terminals 221 comprises a fifth signal terminal and a sixth signal terminal. The fifth signal terminal and the power supply terminal 223 are arranged at the second surface 1221 of the second tongue 122, and the sixth signal terminal and the second ground terminal 222 are arranged at the third surface 1222 of the second tongue 122. That is, the second terminals 22 are assembled to the second surface 1221 and the third surface 1222, respectively. Specifically, the fifth signal terminal and the sixth signal terminal are aligned with each other along a vertical (up and down) direction and along a horizontal (front and rear) direction. Likewise, the power supply terminal 223 and the second ground terminal 222 are aligned with each other vertically and horizontally. In addition, the tail portion 24 of the fifth signal terminal and that of the power supply terminal 223 are extended vertically, the flat contact portion 23 of the sixth signal terminal and that of the second ground terminal 222 are received in the respective terminal positioning slots 136, and the tail portion 24 of the sixth signal terminal and that of the second ground terminal 222 are extended vertically. As shown in FIG. 5, the pins of the second terminals 22 are arranged in front of the pins of the first terminals 21, and the first terminals 21 and the second terminals 22 are substantially grouped into three rows when viewed laterally.

Figure 8:
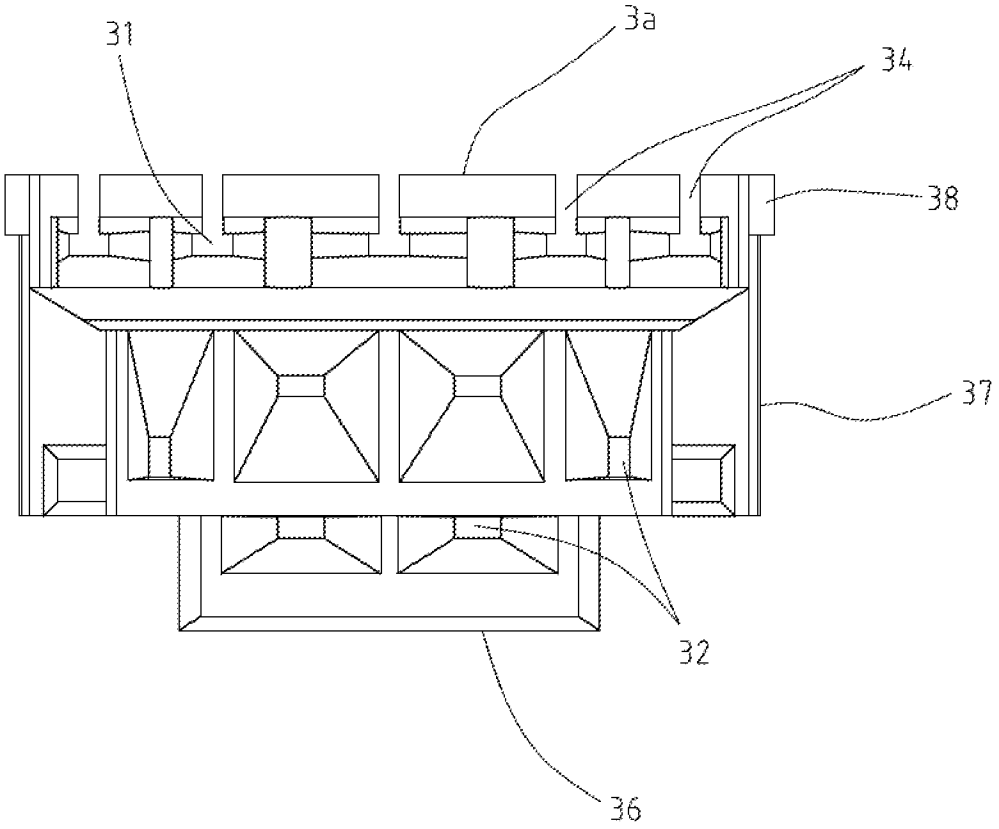
FIG. 8 is a top view of the fixing base of the electrical receptacle connector.
Figure 9:
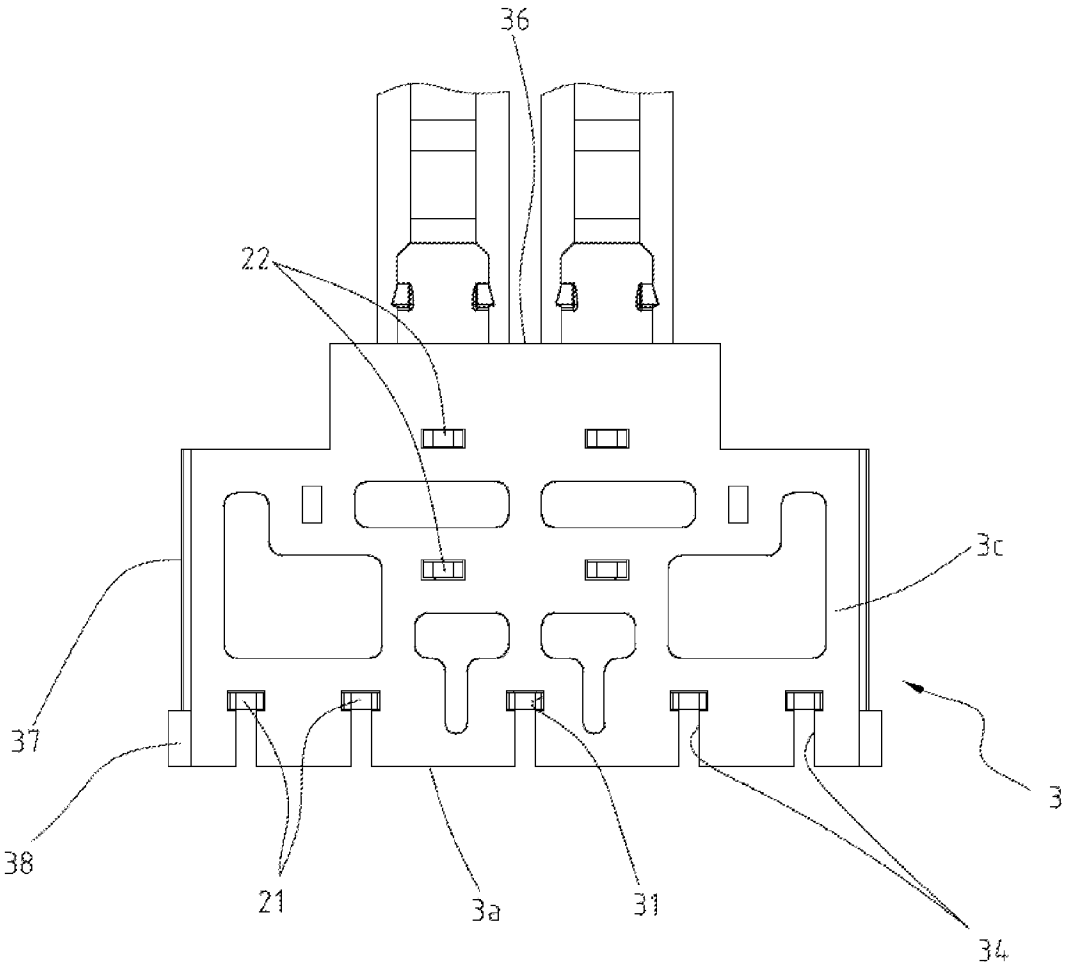
FIG. 9 is a bottom view showing the assembly of the fixing base and a plurality of pins.

Please refer to FIG. 2, FIG. 3, and FIG. 5 to FIG. 9. The fixing base 3 comprises a bottom portion 36 and a baffle plate 37 extended vertically from the rear part of the bottom portion 36. That is, the fixing base 3 would be approximately formed as an L-profile structure when viewed laterally. Here, the fixing base 3 is received in the assembling space 134, and the fixing base 3 defines a plurality of first through holes 31 and a plurality of second through holes 32. The first through holes 31 are defined on the baffle plate 37, and the second through holes 32 are defined on the bottom portion 36. The pins of the first terminals 21 are passing through the respective first through holes 31, and the pins of the second terminals 22 are passing through the respective second through holes 32. In addition, the fixing base 3 has a front surface **3*d* and a rear wall surface 3*a* formed at the rear portion thereof. The front surface 3*d* faces to the assembling space 134. The rear wall 3*a* is opposite to the front surface 3*d* and away from the assembling space 134. The rear wall surface 3*a* defines a plurality of grooves 34 communicating with the respective first through holes 31. Specifically, the grooves 34 may be defined through the baffle plate 37. Further, the width of each of the grooves 34 is less than the width of the corresponding first through hole 31. As shown in FIG. 8, each of the first through holes 31 and the corresponding groove 34 are formed as a T-profile opening. Namely, for each of the T-profile openings, the width of the bottom part is less than the width of the top part. Here, each of the grooves 34 is defined from the corresponding first through hole 31 to the rear wall surface 3*a* of the baffle plate 37 and extended through the baffle plate 37. That is, the first through hole 31 are not enclosed completely. As shown in FIG. 8, for each of the first through holes 31, parts of the inner wall of the first through hole 31 are opened and communicate with the outside of the fixing base 3 through the corresponding groove 34. In addition, each of the grooves 34 is defined from a top 3*b* of the baffle plate 37 to a bottom 3*c* of the baffle plate 37 and extended through the baffle plate 37. Moreover, one of the grooves 34 is corresponding to one of the first through holes 31**.

Two engaging blocks 38 are formed at two sides of the baffle plate 37, respectively. Accordingly, the engaging blocks 38 of the baffle plate 37 are engaged with the two lateral walls 132 of the base portion 13 when the baffle plate 37 is assembled upward to the assembling space 134 defined at the rear portion of the base portion 13. Therefore, the fixing base 3 can be steadily positioned to the insulated housing 1.

Please refer to FIG. 2 and FIG. 3. The metallic shell 4 defines a receiving cavity 40 therein, and the insulated housing 1 is received in the receiving cavity 40. The metallic shell 4 surrounds four sides of the outside of the insulated housing 1 and defines the connecting space 11 with the insulated housing 1. The metallic shell 4 comprises a top wall 41, two sidewalls 42, a front wall, and a rear cover 44. The two sidewalls 42 are extended downward from opposite sides of the top wall 41. The rear cover 44 is fixed to the rear side of the top wall 41 to enclose the rear part of the insulated housing 1. Two fixing legs 421 are respectively extended downward from the two sidewalls 42. Two sides of the front wall are respectively engaged with the two sidewalls 42. The front wall defines an opening 430 communicating with the connecting space 11 and comprises elastic pieces extended toward the connecting space 11. The fixing legs 421 are arranged at two sides of the two pairs of differential signal terminals 211, 212 of the first terminals 21. Accordingly, the interferences between the first pair of differential signal terminals 211 and the second pair of differential signal terminals 212 can be reduced, and the attenuation of the differential signals can be prevented.

Based on the above, the grooves are defined on the rear wall surface of the fixing base and communicate with the respective first through holes. Further, the grooves are defined through the baffle plate from the respective first through holes to the rear wall surface of the baffle plate. In addition, for each of the first through holes, parts of the inner wall of the first through hole are opened and communicate with the outside of the fixing base through the corresponding groove. Further, each of the grooves is defined through the baffle plate from a top thereof to a bottom thereof. Therefore, the cost of the material for manufacturing the fixing base can be reduced, and the overall cost of the electrical receptacle connector can be reduced as well.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, defining a receiving cavity therein;

an insulated housing, received in the receiving cavity, the insulated housing defining a connecting space therein, the insulated housing comprising a tongue portion and a base portion, wherein the tongue portion is extended into the connecting space, and the base portion is arranged at the rear part of the tongue portion, wherein the connecting space comprises a first connecting partition and a second connecting partition communicating with each other, wherein the tongue portion comprises a first tongue and a second tongue parallel to each other, the first tongue is received in the first connecting partition, and the second tongue is received in the second connecting partition, wherein the base portion has a rear wall, two lateral walls, an assembling space, and a plurality of terminal positioning slots, the two lateral walls are extended backward from the rear wall, the assembling space is defined by the rear wall and the two lateral walls, and the terminal positioning slots are defined through the rear wall and communicate with the assembling space and the connecting space;

a plurality of conductive terminals, comprising a plurality of first terminals and a plurality of second terminals, wherein the first terminals and the second terminals are inserted into the respective terminal positioning slots, wherein the first terminals are at the first tongue, the second terminals are at the second tongue, wherein each of the first terminals and the second terminals has a pin extended backward from the corresponding terminal positioning slot to the assembling space, and the pins are bent and extended vertically; and a fixing base received in the assembling space, wherein the fixing base comprises a bottom portion and a baffle plate extended from the rear part of the bottom portion and extended along vertically, and defines a plurality of first through holes and a plurality of second through holes, the pins of the first terminals are passing through the respective first through holes, the pins of the second terminals are passing through the respective second through holes, wherein the fixing base has a rear wall surface defining a plurality of grooves, the grooves communicate with the respective first through holes, and the width of each of the grooves is less than the width of the corresponding first through hole, each of the first through holes and each of the grooves are arranged at the baffle plate, and each of the second through holes is defined at the bottom portion, and each of the grooves is defined from the corresponding first through hole to the rear wall surface of the baffle plate and extended through the baffle plate.

2. The electrical receptacle connector according to claim 1, wherein each of the grooves is defined through the baffle plate from a top of the baffle plate to a bottom of the baffle plate.

3. The electrical receptacle connector according to claim 1, wherein the number of the first terminals is five, the five pins of the five first terminals are arranged in a row, wherein the number of the second terminals is four, the four pins of the four second terminals are arranged alternately, such that the four pins of the four second terminals are arranged in two parallel rows.

4. The electrical receptacle connector according to claim 1, wherein the first terminals comprise a ground terminal and two pairs of differential signal terminals arranged at two sides of the ground terminal.

5. The electrical receptacle connector according to claim 4, wherein each terminal of the two pairs of differential signal terminals comprises a flat contact portion, a tail portion and a bending portion, wherein the flat contact portion is arranged at the first tongue, the tail portion is extended from the rear of the flat contact portion and passing through the corresponding first through hole, the bending portion is formed between the flat contact portion and the tail portion.

6. The electrical receptacle connector according to claim 4, wherein the width of the pin of the ground terminal is greater than the width of the pin of each terminal of the two pairs of differential signal terminals.

7. The electrical receptacle connector according to claim 1, wherein the first tongue has a first surface facing the second tongue, and the first terminals are assembled at the first surface, wherein the second tongue has a second surface and a third surface, the second surface is facing the first surface, the third surface is opposite to the second surface, and wherein the second terminals are assembled at the second surface and the third surface.

8. The electrical receptacle connector according to claim 1, wherein the thickness of the first tongue is less than the thickness of the second tongue.

9. An electrical receptacle connector, comprising:

a metallic shell, defining a receiving cavity therein;

an insulated housing, received in the receiving cavity, the insulated housing defining a connecting space therein, the insulated housing comprising a tongue portion and a base portion, wherein the tongue portion is extended into the connecting space, and the base portion is arranged at the rear part of the tongue portion, wherein the connecting space comprises a first connecting partition and a second connecting partition communicating with each other, wherein the tongue portion comprises a first tongue and a second tongue parallel to each other, the first tongue is received in the first connecting partition, and the second tongue is received in the second connecting partition, wherein the base portion has a rear wall, two lateral walls, an assembling space, and a plurality of terminal positioning slots, the two lateral walls are extended backward from the rear wall, the assembling space is defined by the rear wall and the two lateral walls, and the terminal positioning slots are defined through the rear wall and communicate with the assembling space and the connecting space;

a plurality of conductive terminals, comprising a plurality of first terminals and a plurality of second terminals, wherein the first terminals and the second terminals are inserted into the respective terminal positioning slots, wherein the first terminals are at the first tongue, the second terminals are at the second tongue, wherein each of the first terminals and the second terminals has a pin extended backward from the corresponding terminal positioning slot to the assembling space, and the pins are bent and extended vertically; and a fixing base received in the assembling space, wherein the fixing base defines a plurality of first through holes and a plurality of second through holes, the pins of the first terminals are passing through the respective first through holes, the pins of the second terminals are passing through the respective second through holes, wherein the fixing base has a front surface and a rear wall, the front surfaces faces to the assembling space, the rear wall surface is opposite to the front surface and away from the assembling space, the rear wall surface defining a plurality of grooves, and the grooves communicate with the respective first through holes, and the width of each of the grooves is less than the width of the corresponding first through hole.

10. The electrical receptacle connector according to claim 9, wherein one of the grooves is corresponding to one of the first through holes.

* * * * *